US005311803A

United States Patent [19]

Crowley

[11] Patent Number: 5,311,803

[45] Date of Patent: May 17, 1994

[54] CHEESE SLICER

[76] Inventor: Timothy J. Crowley, P.O. Box 171, Treadwell, N.Y. 13846

[21] Appl. No.: 18,310

[22] Filed: Feb. 16, 1993

[51] Int. Cl.[5] ..... B26D 1/547

[52] U.S. Cl. ..... 83/745; 83/651.1; 83/932

[58] Field of Search ..... 83/745, 932, 651.1, 83/613; 30/116

[56] References Cited

U.S. PATENT DOCUMENTS

| | | | |
|---|---|---|---|
| 1,002,431 | 9/1911 | Nonck | 83/651.1 X |
| 1,685,533 | 9/1928 | Donnellan | 30/116 X |
| 1,705,257 | 3/1929 | Lockett | 30/117 |
| 2,135,113 | 11/1938 | Rehbein | 83/449 |
| 2,718,198 | 9/1955 | Bayley | 30/116 X |
| 2,825,131 | 3/1958 | Cole | 30/116 |
| 3,435,524 | 4/1969 | Moore | 83/761 |
| 4,697,488 | 10/1987 | Cole | 83/437 |
| 4,756,083 | 7/1988 | Alonso | 83/467.1 X |
| 4,871,156 | 10/1989 | Kozyrski | 83/455 X |
| 4,960,024 | 10/1990 | Holcomb | 83/423 |

FOREIGN PATENT DOCUMENTS 632209 11/1949 United Kingdom ..... 83/651.1

*Primary Examiner*—Richard K. Seidel
*Assistant Examiner*—Kenneth E. Peterson
*Attorney, Agent, or Firm*—Richard C. Litman

[57] ABSTRACT

A slicer generally resembling a hand held wood planing tool sits atop a block of food to be sliced or shaved, such as cheese. The slicer has a main platform or base which supports a carriage slidable on a guide groove formed in the base. The carriage supports a shaft rotatably mounted therein, from which shaft depends a pair of arms holding a cutting wire between them. The arms are pivotally and adjustably mounted to the shaft. The arms are fixed in place at a desired cutting depth by a screw. A stop located on the underside of the base counteracts the tendency of the block of food to be pushed by the cutting wire. A curved handle disposed upon the carriage enables the same to be moved, thus slicing the food, with one palm bearing thereagainst.

4 Claims, 2 Drawing Sheets

CHEESE SLICER

BACKGROUND OF THE INVENTION

1. Field of the Invention

The present invention relates to a tool for slicing blocks of food such as cheese.

2. Description of the Prior Art

Cheese slicers which operate by drawing a wire through a block of cheese are known. One such slicer is shown in U.S. Pat. No. 1,705,257 issued Mar. 12, 1929 to William Lockett, disclosing a cradle for holding a block of butter, vertical walls of which guide a handle holding a cutting wire in tension. The direction of the cut is horizontal, thus advancing the cutting wire longitudinally along the block of butter. The cutter is interlocked with a groove formed in the cradle, but is pivotally retained thereon.

Another cheese slicer is shown in U.S. Pat. No. 2,135,133, issued Nov. 1, 1938 to Elmer C. Rehbein, which slicer provides a tray having two low vertical lateral walls, and on which tray a wire cutter is pivotally mounted. A block of food is manually advanced on the tray, and the cutter descends in an arcuate cutting path.

An improvement for use with a conventional cheese slicer is shown in U.S. Pat. No. 3,435,524, issued Apr. 1, 1969 to Herbert L. Moore. The improvement comprises a partial frame which is lowered over a block of food, and which frame holds a conventional wire cutter. Wire engaging grooves and graduations inscribed on the frame enable a user to position the cutter to produce slices of desired dimension. The entire apparatus is drawn horizontally over a block of food held immobile on a working surface, such as a tabletop.

U.S. Pat. No. 4,697,488 issued Oct. 6, 1987 to Gregory B. Cole, disclosing a slicing apparatus which surrounds the block of food, pushes the block of food progressively through the apparatus, and also provides a pivotally mounted cutter which penetrates the food along an arcuate path, in the manner of Rehbein '113.

Another cheese slicer which may be deemed of interest is shown in U.S. Pat. No. 4,960,024, issued Oct. 2, 1990 to David A. Holcomb. This slicer provides a structure fully surrounding a block of food, and having a rotary knob geared to a wall which acts to push the block of food progressively through the structure. At the open mouth of the structure, a cutting blade is disposed which descends in tracks or grooves, thus cutting the food in the manner of a guillotine.

None of the above inventions and patents, taken either singly or in combination, is seen to describe the instant invention as claimed.

SUMMARY OF THE INVENTION

The present invention provides a cheese slicer having a main platform or base which sits on the upper surface of a block of food. A pair of arms holding a cutting wire between them is supported on a carriage which slides horizontally along a guiding groove formed in the base. The arms are pivotally and adjustably mounted to the carriage, and are locked in place by a screw when the wire is positioned to a desired cutting depth. A stop located on the underside of the platform counteracts the tendency of the block of food to be pushed by the cutting wire.

The novel slicer generally resembles a hand held wood plane. A curved handle conforms to the palm of a user, such that the carriage can be moved, thus slicing the food, with one palm bearing thereagainst.

Accordingly, it is a principal object of the invention to provide a food slicer which is supported on an upper surface of a block of food.

It is another object of the invention to provide a cutting element depending from a platform riding on the upper surface of a block of food.

It is a further object of the invention to selectively vary cutting depth of the cutting element.

Still another object of the invention is to provide a food slicer which is pushed by downward and forward pressure exerted by the palm or hand of an operator.

A further object of the invention is to provide a food slicer having a cutting element which is guided by and entrapped within the slicer.

It is an additional object of the invention to provide a food slicer having a slicer moving through a horizontal and longitudinal cutting path.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
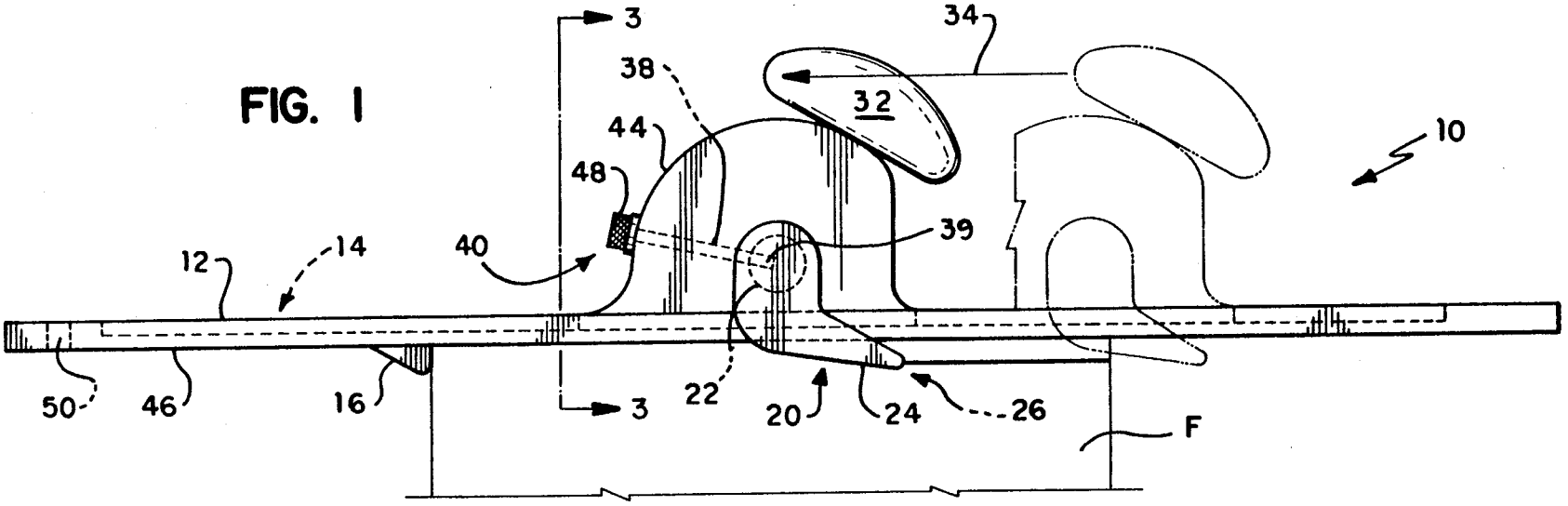
FIG. 1 is an environmental side elevational view of the cheese slicer according to the present invention showing progressive movement of the slicer in phantom lines.

The present invention provides a slicing apparatus 10 which is placed atop a block of food F, such as cheese. The slicing apparatus 10 is seen in FIG. 1 to comprise a platform or base 12 defining a longitudinal guide groove 14 and having a depending stop 16. A carriage 18 is slidably retained within the guide groove 14. The carriage 18 supports a cutter 20, comprising a shaft 22, two arms 24, 24 (only one arm 24 being visible in FIG. 1) holding a cutting wire 26 under tension therebetween, and a slice thickness adjusting arrangement, which will be further described hereinafter. Better seen in FIG. 2, the shaft 22 extends beyond lateral edges 28A,28B of the base 12, arms 24,24 being located at and solidly attached to the respective proximal and distal ends 30A,30B of shaft 22. Cutting wire 26 thus spans the width of the block of food F being sliced.

A handle 32 is mounted to carriage 18. Preferably configured to conform to a user's hand or palm (not shown), the handle 32 enables the user to slice the food F by pushing downwardly and forwardly (indicated by arrow 34) on the handle 32. As the cutting wire 26 is not as sharp as a knife blade or the like, the food F may have a tendency to slide forward on the work surface, such as a tabletop (not shown), the slicing apparatus 10 merely pushing the block of food F forwardly, and not slicing it. This tendency is counteracted by stop 16. Cutting action is controlled by the user modifying the downward component of manual pressure relative to forward component thereof to secure satisfactory results.

Figure 2:
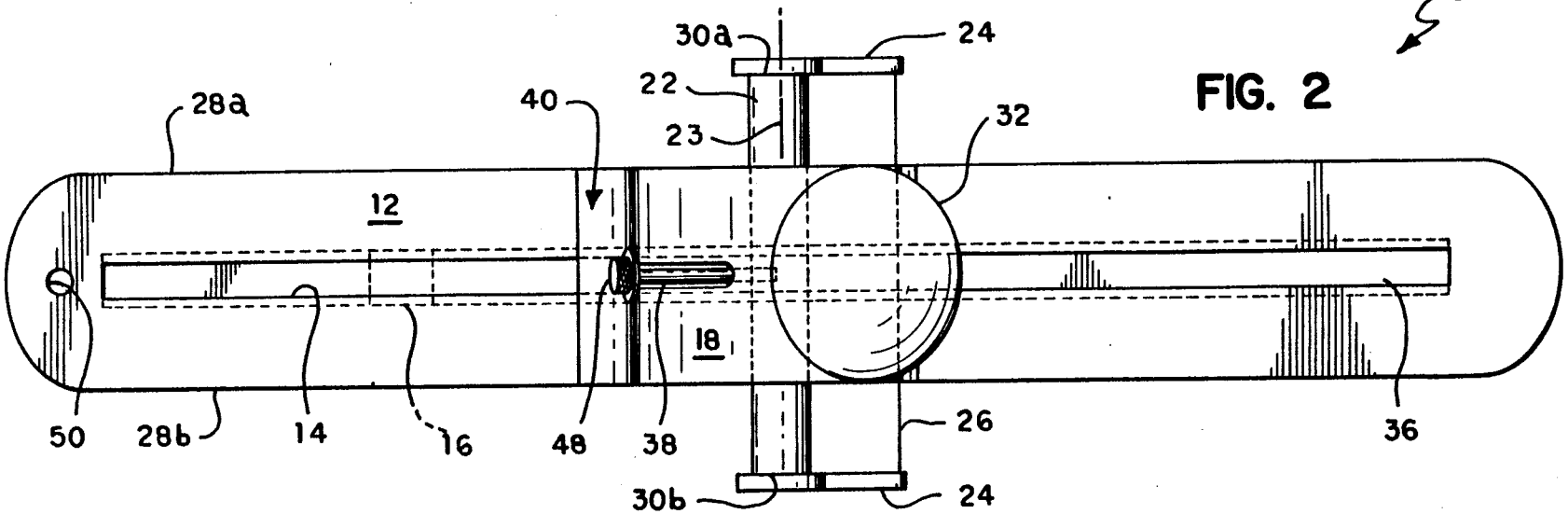
FIG. 2 is a top plan of the cheese cutter slicer shown in FIG. 1, showing concealed features of the slicer in hidden lines.

For further stability and ease of use of the invention, the user's other hand may be employed to grasp base 12, preferably at the right hand side in the sense of FIGS. 1 and 2, as handle 32 is pushed towards the left.

Figure 3:
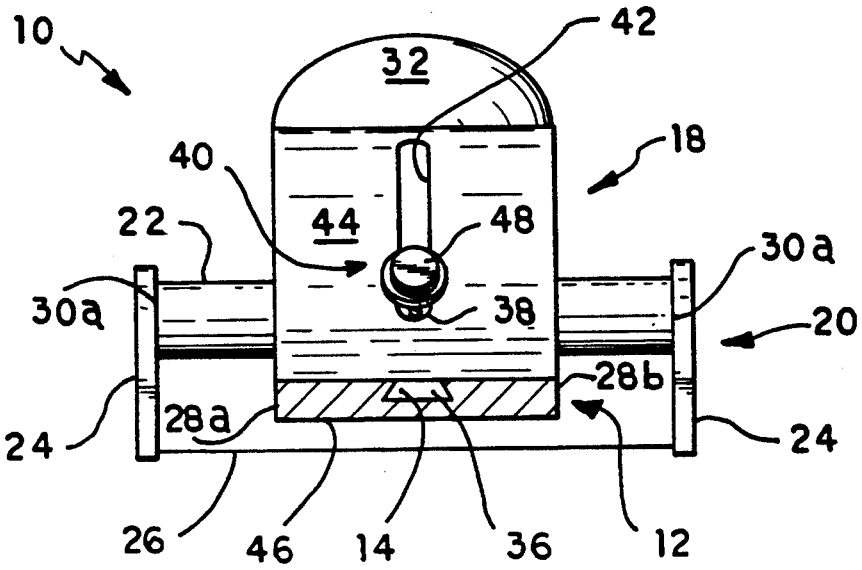
FIG. 3 is a front elevational view of the cheese slicer shown in FIG. 1 showing a cross section of the base taken along lines 3—3.

Turning now to FIG. 3, guide groove 14 is seen to be configured so as to entrap a cooperating member 36 attached to carriage 18. Carriage 18 is thus constrained to slide along base 12, but will not detach therefrom.

Adjustment of cutting depth will now be explained. A screw 38 having an enlarged head 40 is seen to penetrate a slot 42 formed in carriage 18. Slot 42 is arranged perpendicularly to axis 23 of shaft 22, thus enabling screw 38 to assume a rotational attitude along a range of rotation of shaft 22. Screw 38 engages a threaded hole 39 formed in shaft 22.

Figure 4:
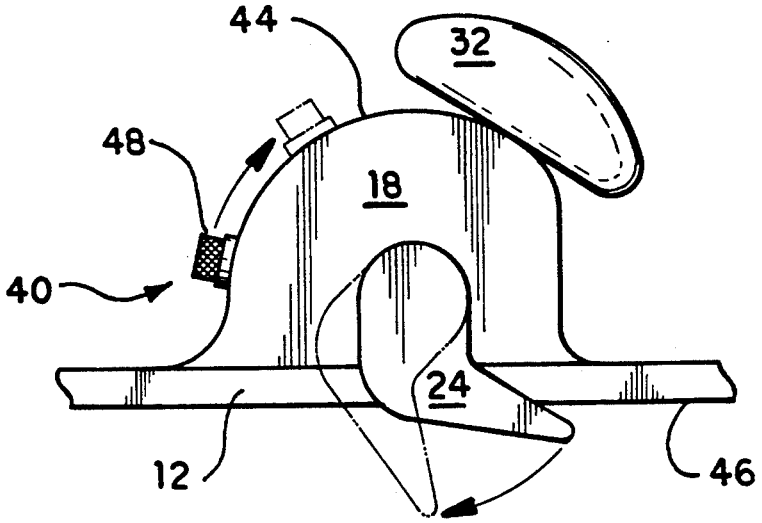
FIG. 4 is a partial side elevational view of the cheese slicer shown in FIG. 1 showing the radial movement of the cutter in phantom lines.

Depth of a cut, and therefore, thickness of the slices, is adjusted by screw 38, with reference being made to FIG. 4. Shaft 22 is supported within carriage 18 so as to be able to rotate about its longitudinal axis 23 (see FIG. 2). Arms 24,24 (only one arm 24 being seen in this view) and screw 38 are movable from the position shown in solid lines to another position, illustratively shown in broken lines.

Carriage 18 has an arcuate outer surface 44, concentric with shaft 22, in which slot 42 is located. When shaft 22 is rotated within the carriage 18, cutting wire 26 is raised or lowered with respect to the bottom surface 46 of base 12. The screw 38, grasped by the knurled section 48 of head 40, is tightened when the cutting wire 26 is adjusted to a desired cutting thickness. Friction between the enlarged head 40 and arcuate surface 44 prevents screw 38 from rotating in response to a force urging shaft 22 to rotate, thus effectively locking shaft 22 in a desired position.

A hole 50 (see FIGS. 1 and 2) is located in base 12 to facilitate hanging the slicing apparatus 10 when not in use.

The novel slicing apparatus 10 thus enables a user to slice a block of food F along a longitudinal dimension of the block repeatedly, little if any of the structure of the slicing apparatus 10 protruding downwardly to interfere with a working surface. Also, a cutting arrangement is provided that is solidly interlocked with the slicing apparatus, and held solidly at a desired cutting depth, so that cut depth consistency is not dependent upon the user's tight grasp of the apparatus. Also, cutting depth is selectively fixed along an infinitely adjustable range.

It is to be understood that the present invention is not limited to the sole embodiment described above, but encompasses any and all embodiments within the scope of the following claims.

I claim:

1. A cheese slicer which sits atop and is supported by a block of cheese when being used, said cheese slicer comprising:

a substantially planar base having lateral edges;

a cutter means which comprises:

a carriage slidably mounted on said base;

a shaft having an axis and first and second ends, said shaft being rotatably mounted about said axis on said carriage and extending laterally beyond said edges of said base;

a first arm and a second arm each having proximal and distal ends, said first arm being solidly attached to the first end of the shaft, said second arm being solidly attached to the second end of the shaft such that said arms rotate in tandem when said shaft rotates; and wire means held under tension between said distal ends of said arms, said wire means slicing the block of cheese when said cutter means is pushed along said base.

2. The cheese slicer according to claim 1, further comprising thickness adjustment means connected to said carriage, for adjusting depth of said wire means, and therefore determining thickness of slices produced by said cheese slicer.

3. The cheese slicer according to claim 2, wherein said thickness adjustment means comprises:

screw means releasably holding said shaft solidly to said carriage, whereby said shaft is selectively constrained against rotation with respect to said carriage, and said wire means is thus constrained to be positioned selectively at a constant distance below said base.

4. The cheese slicer according to claim 3, said carriage having an arcuate surface concentric with said shaft, said arcuate surface having means defining a slot therein, said slot being perpendicular to said axis of said shaft, said shaft further including means defining a threaded hole extending radially thereinto, said thickness adjustment screw means further comprising:

a screw having an enlarged head, said screw engaging said threaded hole, and extending outwardly so as to pass through said slot, said enlarged head abutting said arcuate surface when being tightened into said threaded hole, whereby said enlarged head frictionally engages said arcuate surface when said screw is tightened, and said shaft is thus immobilized with respect to rotation about said axis thereof.

* * * * *